US006481868B1

(12) United States Patent
Lin

(10) Patent No.: US 6,481,868 B1
(45) Date of Patent: Nov. 19, 2002

(54) WATERPROOF REFLECTOR DEVICE

(76) Inventor: Yuan Lin, 5 Viewmont Court, Doncaster East, 3109 VIC (AU)

( * ) Notice: Subject to any disclaimer, the term of this patent is extended or adjusted under 35 U.S.C. 154(b) by 0 days.

(21) Appl. No.: 09/956,110

(22) Filed: Sep. 20, 2001

(51) Int. Cl.[7] ..... F21V 7/05; F21V 21/08; F21V 31/00

(52) U.S. Cl. ..... 362/247; 362/158; 362/191; 362/249; 362/267

(58) Field of Search ..... 362/102, 158, 362/184, 189, 190, 191, 227, 235–237, 240, 247, 249–252, 267, 278, 320, 103

(56) References Cited

U.S. PATENT DOCUMENTS 4,812,953 A * 3/1989 Ask et al. ..... 362/251
5,410,459 A * 4/1995 Yang ..... 362/249
5,469,342 A * 11/1995 Chien ..... 362/189
5,622,423 A * 4/1997 Lee ..... 362/102
5,746,500 A * 5/1998 Chien ..... 362/191
5,836,673 A * 11/1998 Lo ..... 362/251
6,059,414 A 5/2000 Tsai ..... 359/516

* cited by examiner

*Primary Examiner*—Alan Cariaso
(74) *Attorney, Agent, or Firm*—Troxell Law Office PLLC

(57) ABSTRACT

A reflector device comprises light means including a flexible fastening strip with LEDs secured therein and a switch, a battery assembly, waterproof means including releasable upper and lower sealing strips, a cover strip including a light reflecting layer, a base layer a first space for receiving light mean and a second space for receiving the battery assembly which is adjacent and in communication with waterproof means, and a fastening assembly. This has both waterproof and convenient battery replaceable properties.

26 Claims, 11 Drawing Sheets

WATERPROOF REFLECTOR DEVICE

BACKGROUND OF THE INVENTION

1. Field of the Invention

The present invention relates to reflector devices and more particularly to a waterproof reflector device.

2. Description of Related Art

Reflector belts having light emitting diodes (LEDs) operated by batteries so as to flash regularly as means of warning are well known. It is also known that LEDs, batteries, and associated circuit of reflector belt are subject to damage by permeated water since it is typically used in an outdoor environment. In response, most conventional reflector belts are intended to have a waterproof means. For example, U.S. Pat. No. 6,059,414 disclosed a reflector belt having the following characteristics.

It comprises a light reflecting frame belt 4 having an elongate base 42 and a light reflecting layer 41 covered on the base 42, a flexible cover strip 1 covered on light reflecting layer 41 of light reflecting frame belt 4 and fastened to two opposite end pockets 43 at the light reflecting layer 41 by induction brazing by high-frequency AC current, a LED circuit 2 retained between flexible cover strip 1 and light reflecting frame belt 4, LED circuit 2 having a plurality of LEDs 23 respectively inserted into respective through holes 11 at cover strip 1, and a plurality of bonding patches 3 for fixedly securing circuit boards 22 of LED circuit 2 to light reflecting frame belt 4 and cover strip 1.

However, the prior art suffered from several disadvantages. For example, its assembly is time consuming due to complicated components thereof. Also, user may feel uncomfortable when wearing a device formed of such reflector belt. This is because hard sides of circuit boards 22 may contact the body of user when light reflecting frame belt 4 is flexed. It is known that cover strip 1 is fastened to two opposite end pockets 43 at the light reflecting layer 41 by induction brazing by high-frequency AC current. But there is no discussion about the waterproof property of such formed reflector belt. Moreover, how to replace consumed batteries in reflector belt is a problem if it is a sealed device. It is thus understood that replacement of battery inevitably adversely affects the waterproof property of reflector belt (e.g., frame belt 4) by removing consumed battery by opening the end pockets 43. Further, waterproof property of such reflector belt is poor if cover strip 1 is not sealed in the opposite end pockets 43. In view of above, the prior art is disadvantageous. Thus, it is desirable to provide a waterproof reflector device in order to overcome the above drawbacks of prior art.

SUMMARY OF THE INVENTION

It is thus an object of the present invention to provide a waterproof reflector device comprising a first space and a second space for receiving a waterproof means. By utilizing this, a waterproof and a convenient battery replaceable properties are effected.

It is another object of the present invention to provide a waterproof reflector device wherein the light means comprises a light emitting diode (LED) assembly having a plurality of spaced LEDs and two electric wires with the LEDs coupled therebetween, a flexible fastening strip having a plurality of spaced holes with the LEDs secured therein, and a switch coupled to the electric wires. By utilizing this, a simple assembly is effected.

It is further object of the present invention to provide a waterproof reflector device wherein electric wires of light means are clung to both sides of the flexible fastening strip in the first space for preventing a short circuit from occurring.

It is still further object of the present invention to provide a waterproof reflector device wherein light means comprises a light emitting diode (LED) assembly having a plurality of spaced LEDs so that user may feel a degree of comfort while wearing the reflector device.

It is still further object of the present invention to provide a waterproof reflector device wherein the light reflecting layer comprises two spaced transverse strips for dividing a cover strip into a first space for receiving the light means and a second space. The switch is secured to the transverse strips with the flexible fastening strip on top.

It is still further object of the present invention to provide a waterproof reflector device comprising two side elongate extensions on the cover strip formed by extending the lengthwise strips and the rear end strip to secure to the front end strip. Such extensions may be further utilized to obtain additional advantageous features without sacrificing the waterproof property of first and second spaces.

To achieve the above and other objects, the present invention provides a reflector device comprising light means including a light emitting diode (LED) assembly having a plurality of spaced LEDs and two electric wires with the LEDs coupled therebetween, a flexible fastening strip having a plurality of spaced holes with the LEDs secured therein, and a switch coupled to the electric wires, the switch having a button; a battery assembly including a battery compartment and a battery mounted therein, the battery assembly being electrically coupled to the switch; waterproof means including an upper sealing strip and a lower sealing strip releasably secured to the upper sealing strip; a cover strip including two side strips, a rear end strip, a light reflecting layer, and a base layer with the light means and the battery assembly enclosed by the the light reflecting layer and the base layer by pressing the side strips and the rear end strip for sealing rear ends and sides of the light reflecting layer and the base layer wherein the waterproof means is disposed in front ends of the light reflecting layer and the base layer and the battery assembly is disposed adjacent the front ends of the light reflecting layer and the base layer being communicated with the waterproof means; and a fastening assembly having one surface secured to a bottom of base layer and the other surface secured to an object.

The above and other objects, features and advantages of the present invention will become apparent from the following detailed description taken with the accompanying drawings.

DETAILED DESCRIPTION OF THE PREFERRED EMBODIMENTS

Figure 1:
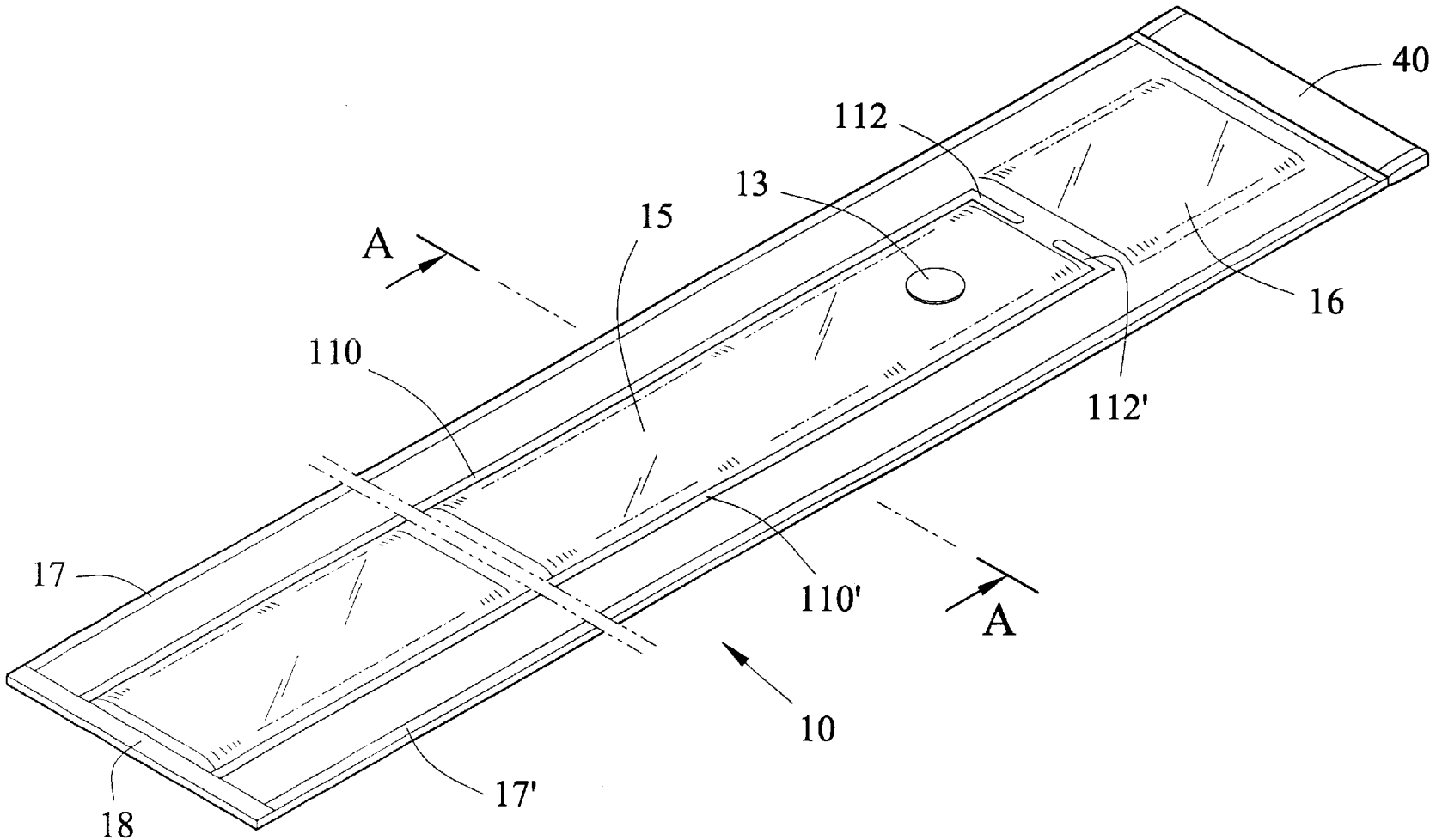
FIG. 1 is a perspective view of a first preferred embodiment of waterproof reflector device according to the invention.
Figure 2:
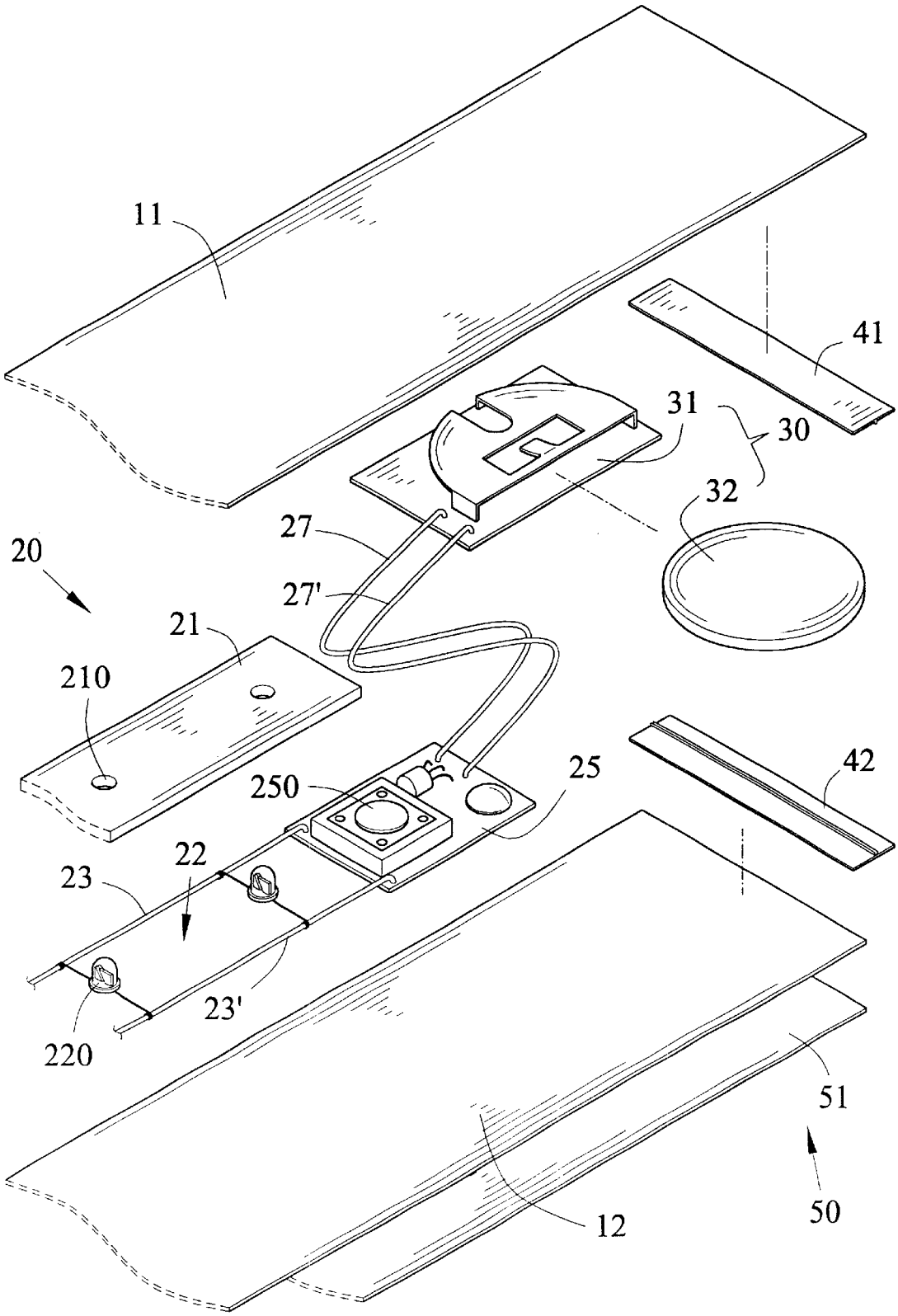
FIG. 2 is an exploded view of FIG. 1 reflector device.

Referring to FIGS. 1 to 5, there is shown a first embodiment of waterproof reflector device constructed in accordance with the invention. Reflector device comprises a cover strip 10 including a light reflecting layer 11, a base layer 12, and a push button 13 (e.g., sticker) adhered on or printed on light reflecting layer 11 directly; a light device 20 including a LED assembly 22 having a plurality of spaced LEDs 220 and two electric wires 23, 23' with LEDs 220 coupled therebetween, a flexible fastening strip 21 having a plurality of spaced apart holes 210 with LEDs 220 secured therein, and a switch 25 coupled to electric wires 23, 23' and having a button 250 disposed corresponding to push button 13 and two electric wires 27, 27' extended therefrom; a battery assembly 30 including a battery compartment 31 and a battery 32 mounted therein, battery assembly 30 being coupled to switch 25 via electric wires 27, 27'; a waterproof device 40 including an upper sealing strip 41 and a lower sealing strip 42; and a fastening assembly 50 including an adhesive layer 51 secured to bottom of base layer 12. In another embodiment bottom of adhesive layer 51 may be adhered to any of other devices such as surface of an article, fence, roadblock, helmet, reflector coat, or raincoat.

The assembly of above components of reflector device will now be described. First, secure light reflecting layer 11 to base layer 12 by pressing two elongate lengthwise strips 110, 110' on light reflecting layer 11. Divide cover strip 10 into two parts (e.g., first space 15 and second space 16) by two spaced transverse strips 112, 112'. Press waterproof device 40 on open side of second space 16 with upper sealing strip 41 secured to bottom of light reflecting layer 11 and lower sealing strip 42 secured to top of base layer 12 respectively. As such, second space 16 may be open or closed by opening or closing waterproof device 40 by clinging or disengaging. Then insert light device 20 into first space 15 for urging switch 25 against transverse strips 112, 112' by flexible fastening strip 21. At this position, switch 25 is secured wherein button 250 is aligned with push button 13. Hence, user may press push button 13 to activate switch 25. Electric wires 27, 27' are passed through the gap between the transverse strips 112, 112' to connect to second space 16. Then pull electric wires 27, 27' from second space 16 to connect to battery compartment 31 with battery 32 installed therein for forming a circuit. Thereafter, mount battery assembly 30 in second space 16. Seal cover strip 10 by pressing two lengthwise side strips 17, 17' and a transverse end strip 18 thereon. Finally, adhere adhesive layer 51 on bottom of base layer 12 to form a reflector device having waterproof and battery replaceable properties.

Figure 3:
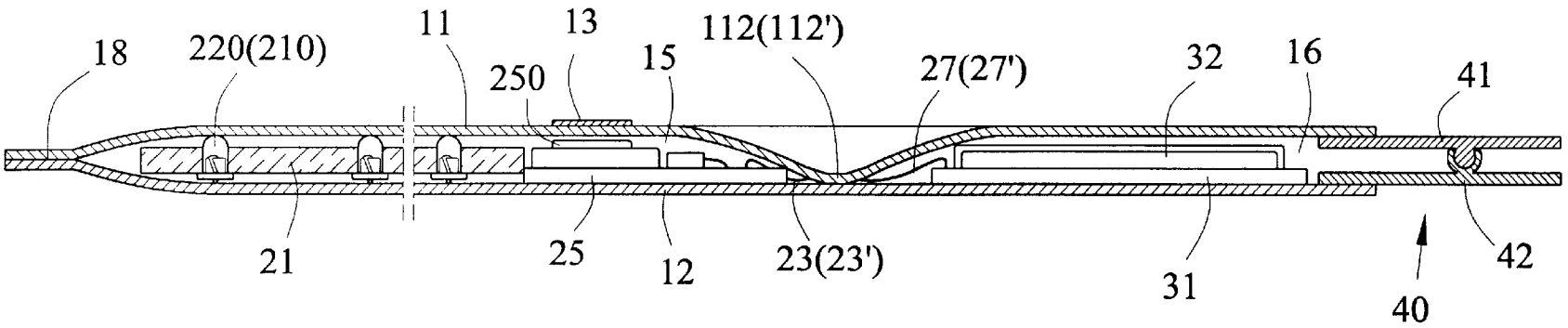
FIG. 3 is a cross-sectional view of FIG. 1 where reflector device is sealed.

As shown in FIG. 3, cover strip 10 has been sealed by side strips 17, 17' and end strip 18 while second space 16 may be open or closed by opening or closing waterproof device 40 by clinging or disengaging. Hence, it is difficult for water to permeate into second space 16 through secured upper sealing strip 41 and lower sealing strip 42, i.e., this reflector device is waterproof.

Figure 4:
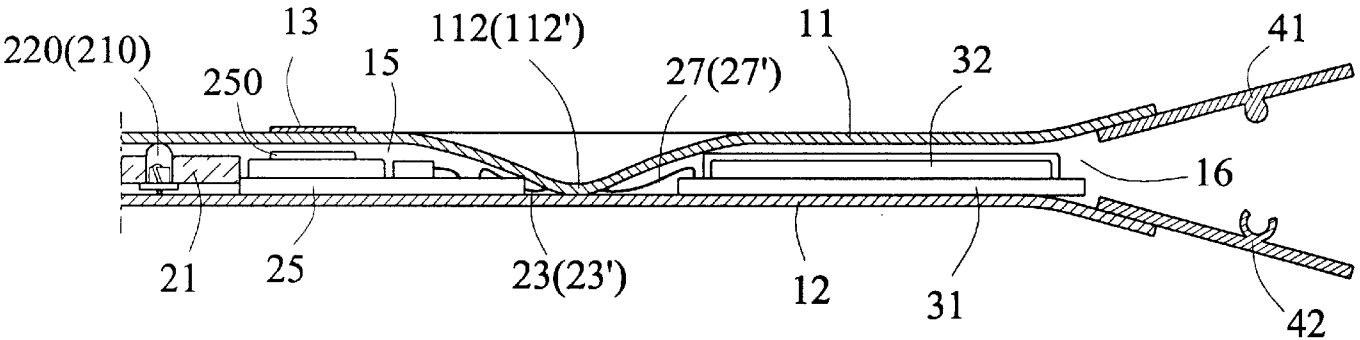
FIG. 4 is a view similar to FIG. 3 where one end of reflector device is open.
Figure 5:
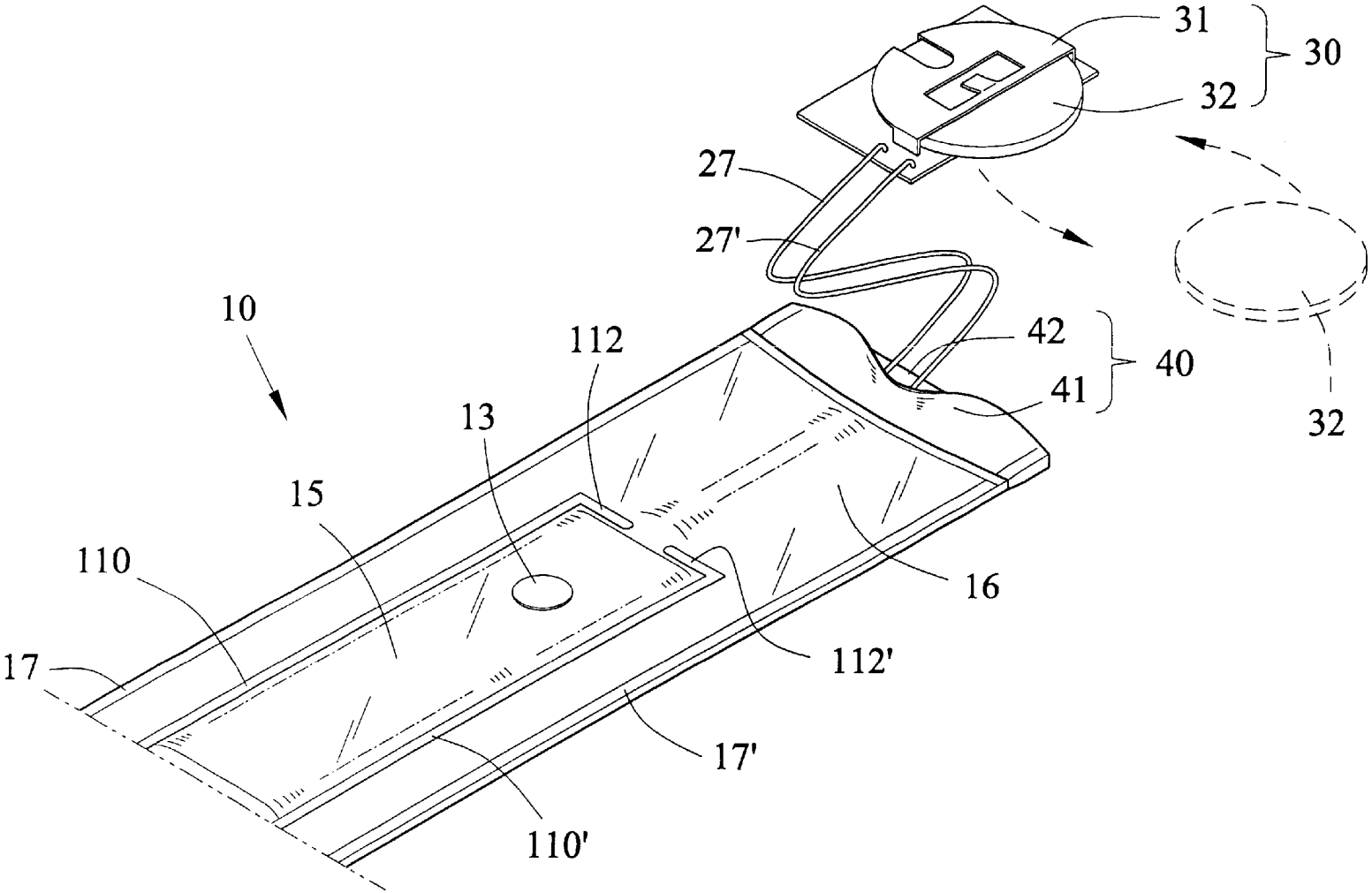
FIG. 5 is a perspective view showing a replacement of battery of reflector device.

Referring to FIGS. 4 and 5 specifically, it is possible of replacing consumed battery 32 by opening waterproof device 40 by disengaging upper sealing strip 41 from lower sealing strip 42, i.e., opening second space 16. In view of above, battery replacement of the reflector device is very convenient without sacrificing the waterproof property.

Figure 4A:
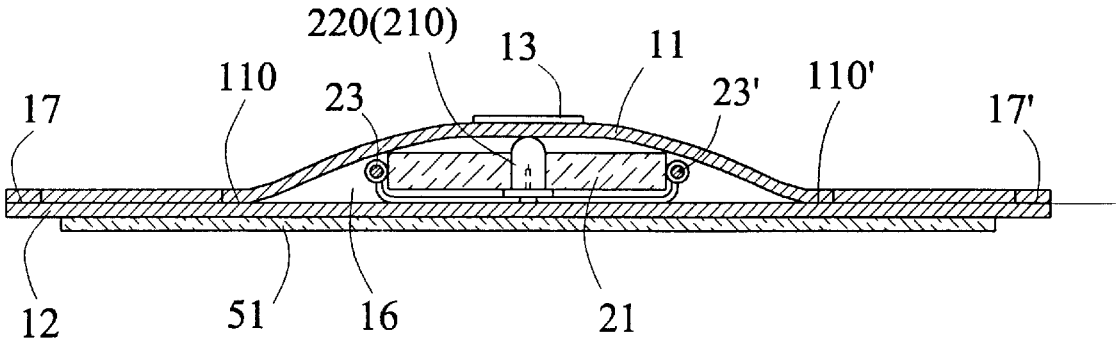
FIG. 4A is another cross-sectional view of FIG. 1 taken along line A—A.
Figure 4B:
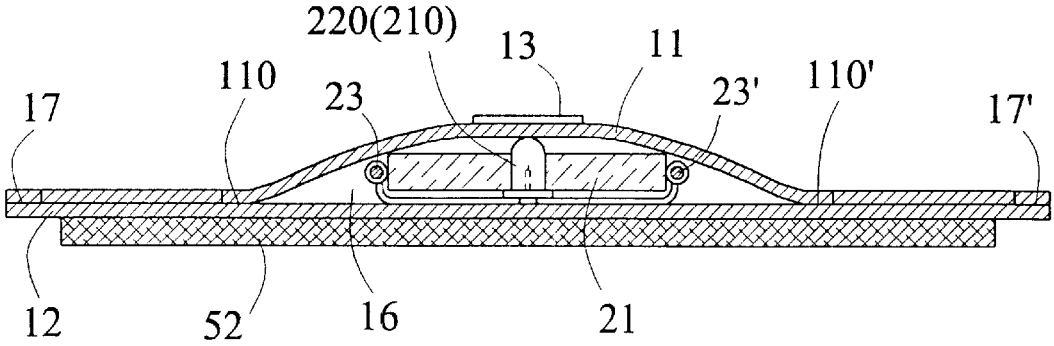
FIG. 4B is a cross-sectional view of another embodiment of fastening assembly of reflector device.

Electric wires 23, 23' are clung to both sides of flexible fastening strip 21 (FIG. 4A). This can prevent a short circuit from occurring by contacting electric wires 23, 23' each other. Fastening assembly 50 may further comprises a Velcro type fastener 52 on the bottom for adhering to any of other devices such as fabric, life-vest, clothes, blanket or raincoat. Preferably, light reflecting layer 11 is formed of reflective material such as PVC. Preferably, base layer 12 is formed of PVC. Preferably, the securing of lengthwise strips 110, 110', transverse strips 112, 112', side strips 17,. 17', end strip 1.8, and waterproof device 40 may be done by induction brazing by high-frequency AC current.

Figure 6:
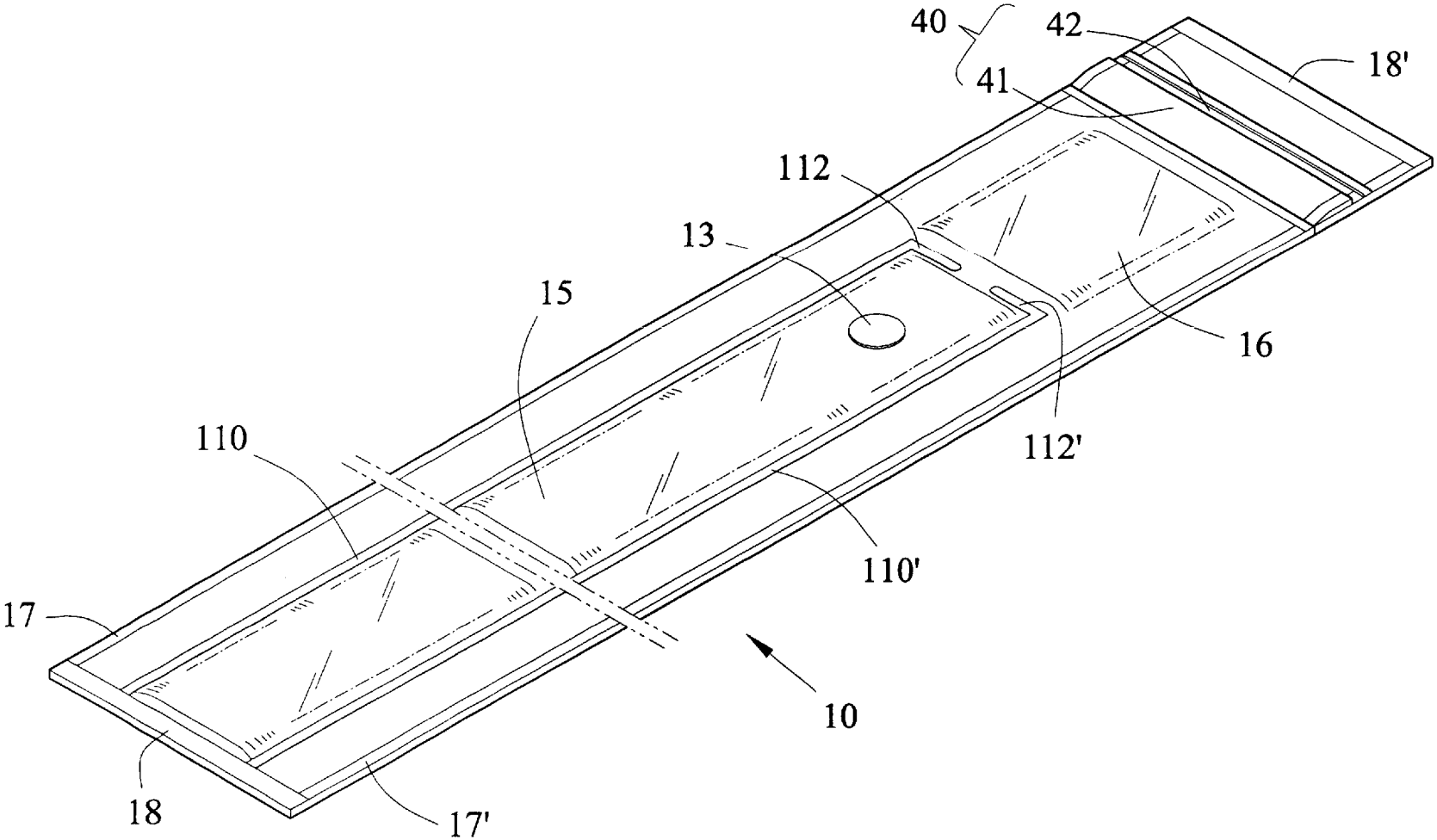
FIG. 6 is a perspective view of a second preferred embodiment of waterproof reflector device according to the invention.
Figure 7:
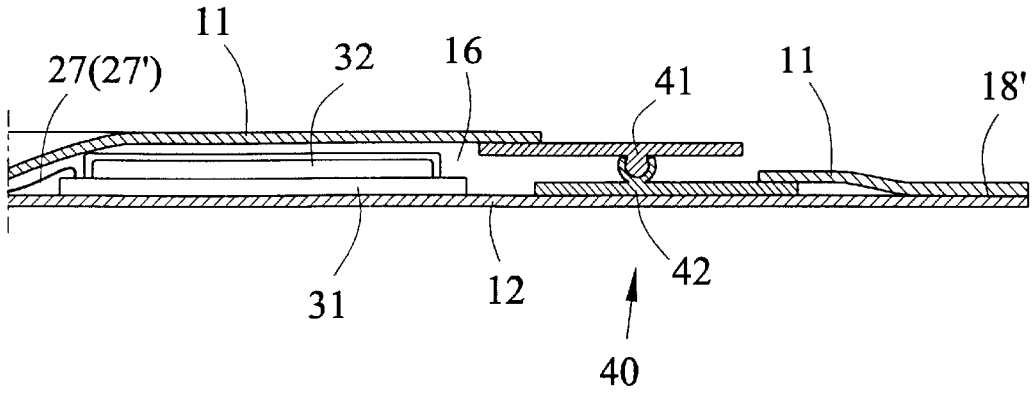
FIG. 7 is a cross-sectional view of FIG. 6 where reflector device is sealed.

Referring to FIGS. 6 and 7, there is shown a second embodiment of the invention, i.e., another embodiment of waterproof device 40. The differences between second and first embodiments are that a portion of light reflecting layer 11 is open with upper sealing strip 41 disposed therein, lower sealing strip 42 is sandwiched between light reflecting layer 11 and base layer 12, and light reflecting layer 11 and base layer 12 are sealed by further pressing end strip 18 thereon. The waterproof and battery replacement properties of the reflector device of this embodiment are the same as the first one. Thus a detailed description thereof is omitted herein for the sake of brevity.

Figure 8:
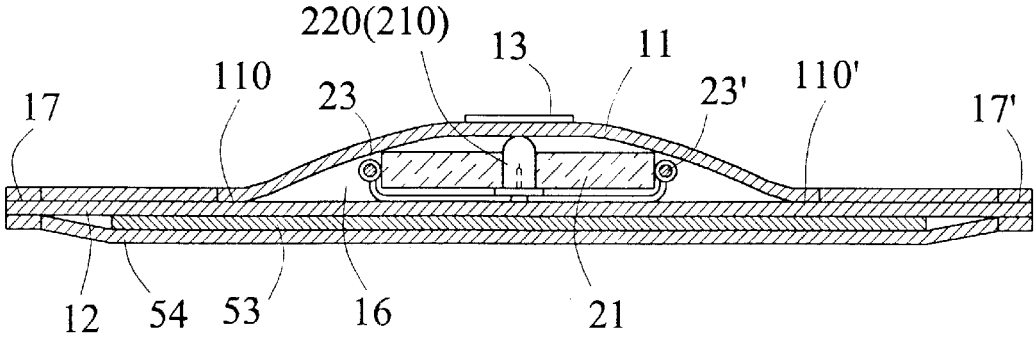
FIG. 8 is a cross-sectional view of a third preferred embodiment of waterproof reflector device according to the invention.

Referring to FIG. 8, there is shown a third embodiment of the invention. The differences between third and first embodiments are that fastening assembly 50 further comprises an elastic metal piece 53 under base layer 12 and a flexible engagement layer 54 with the metal piece 53 sandwiched between base layer 12 and engagement layer 54. Engagement layer 54, light reflecting layer 11, and base layer 12 are secured together by pressing side strips 17, 17' and end strips 18, 18. This embodiment is applicable to wrap around arm, wrist, tube of bicycle, roadblock, or any of other suitable warning devices due to the flexibility of metal piece 53. Preferably, engagement layer 54 is formed of PVC. Further, a pad may be provided on the underside of engagement layer 54 for providing a degree of comfort while wearing on human body. Preferably, the pad is formed of flannel having sweat absorbing capability so as to prevent engagement layer 54 from adhering to body while wearing.

Figure 9:
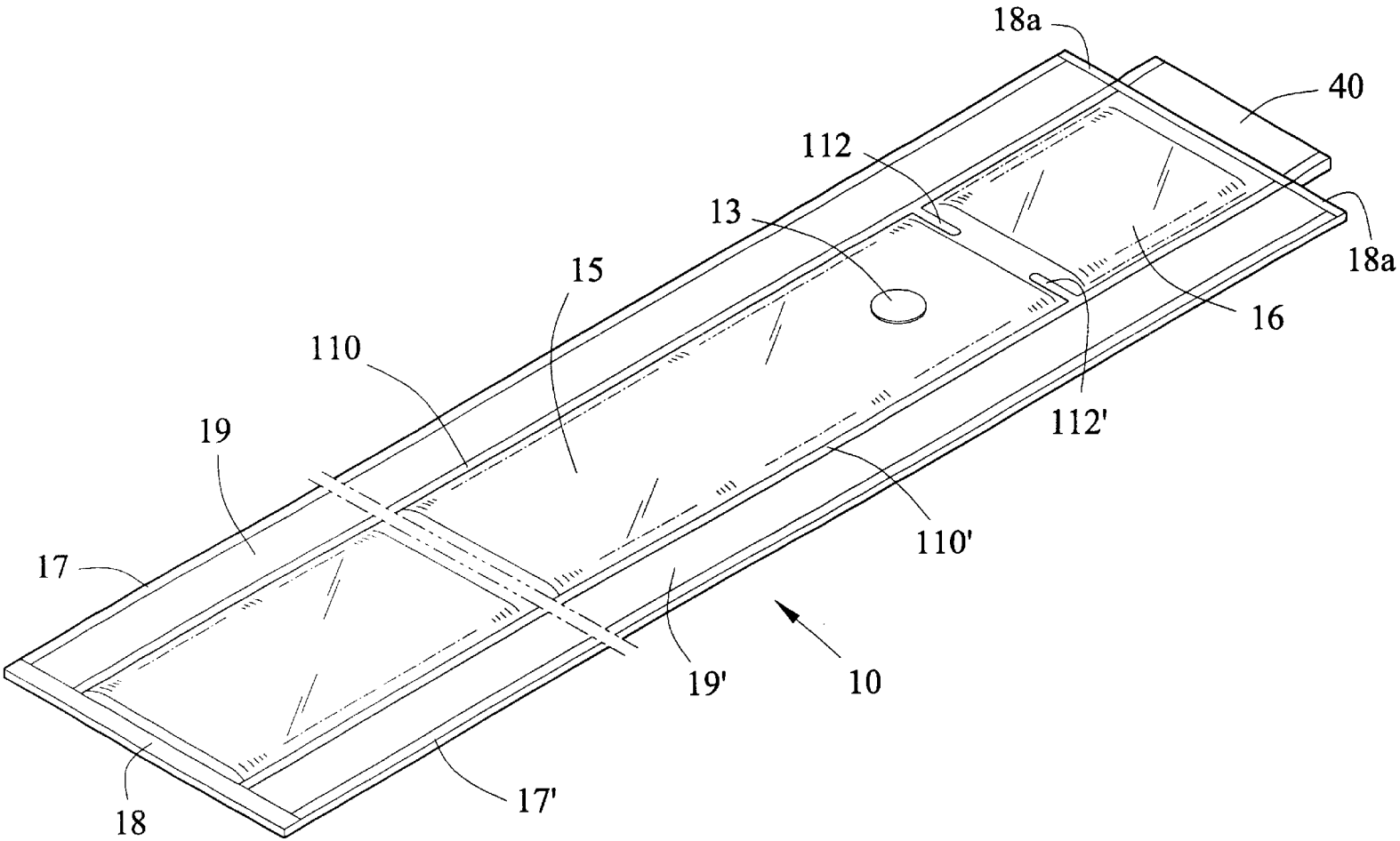
FIG. 9 is a perspective view of a fourth preferred embodiment of waterproof reflector device according to the invention.
Figure 10:
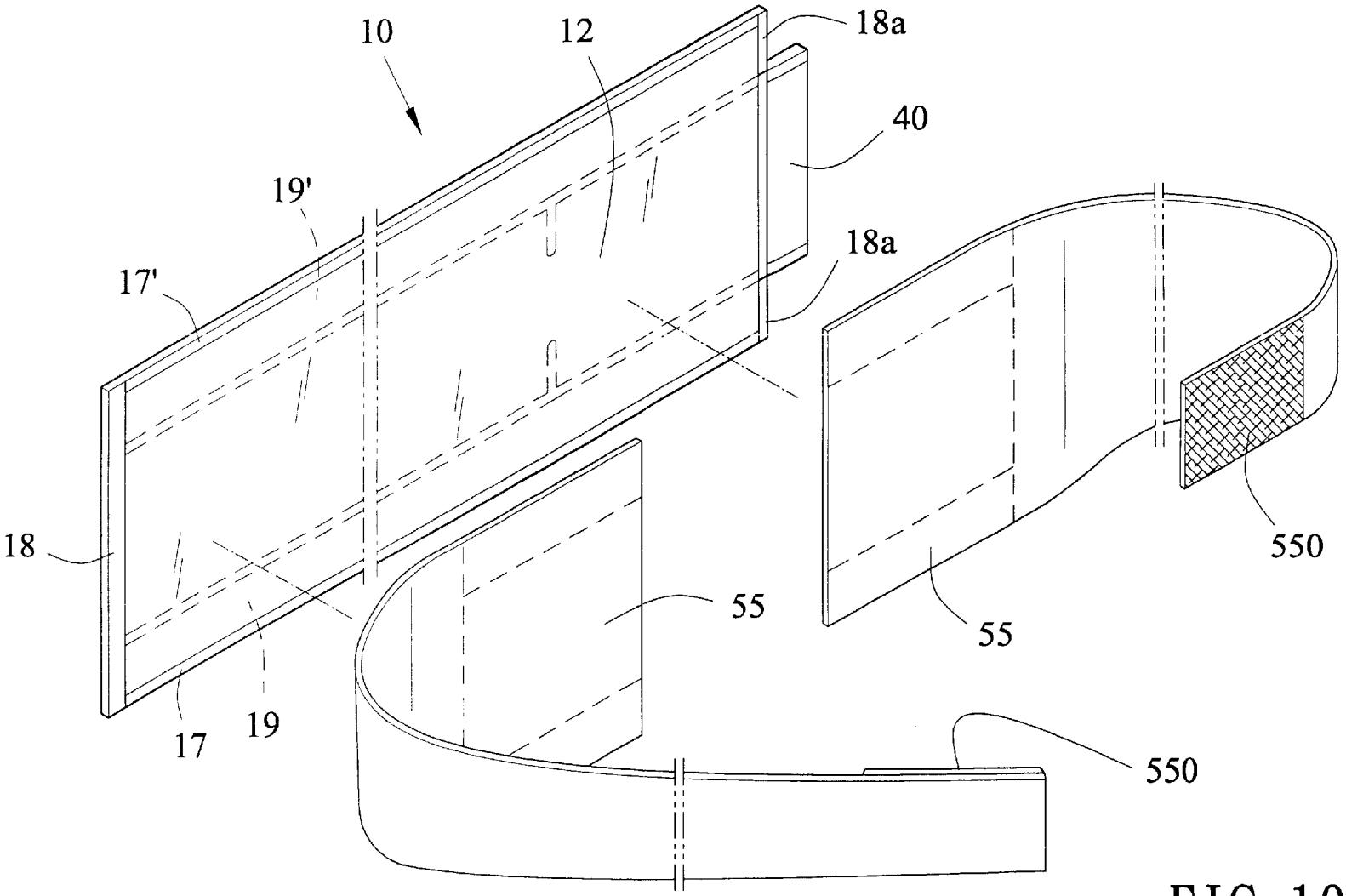
FIG. 10 is an environmental view of a fifth preferred embodiment of waterproof reflector device according to the invention.
Figure 11:
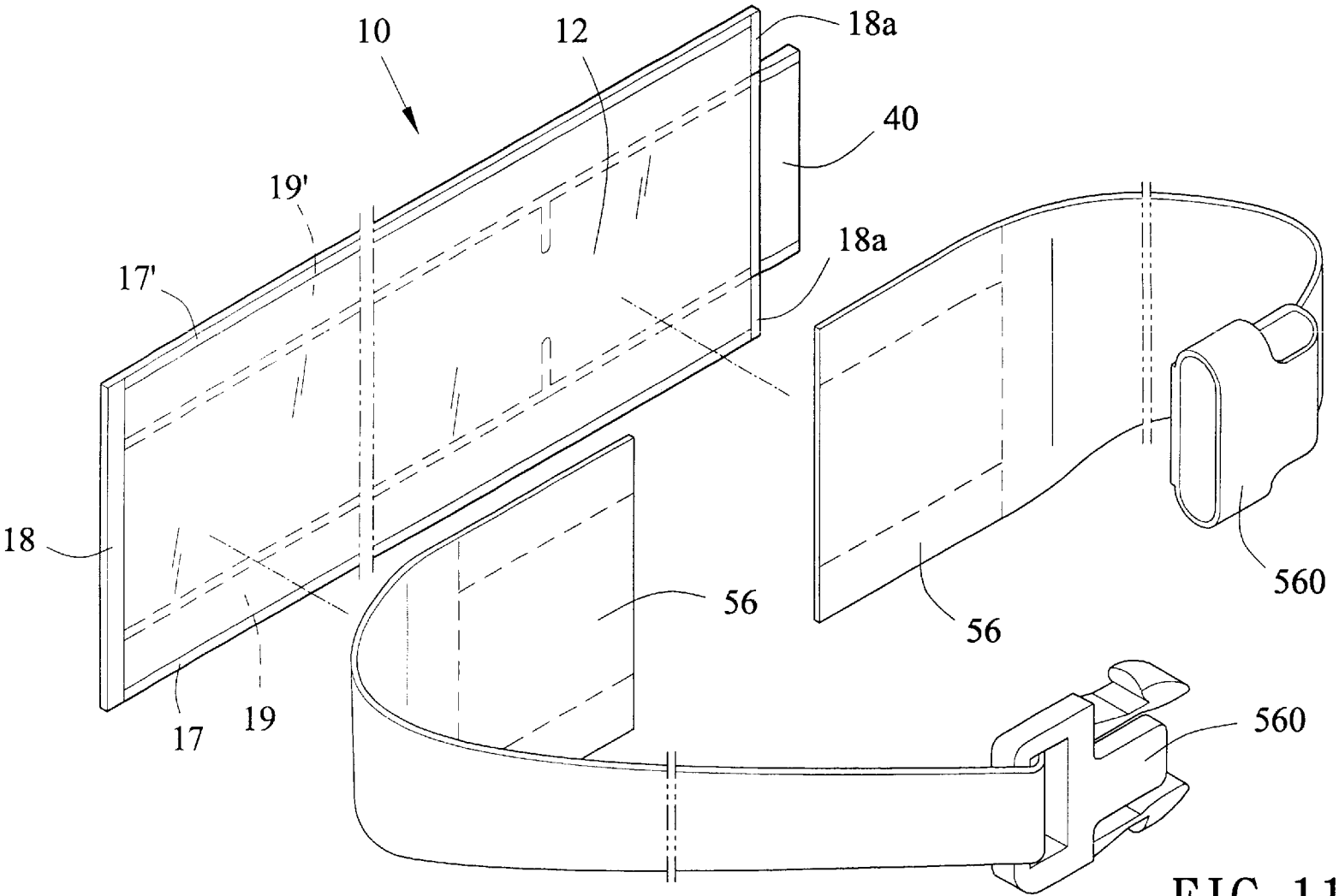
FIG. 11 is an environmental view of a sixth preferred embodiment of waterproof reflector device according to the invention.

Referring to FIGS. 9 to 11, two side elongate extensions 19, 19' are formed on cover strip 10 by extending lengthwise strips 110, 110' and end strip 18 to secure to the other end strip 18a. Such extensions 19, 19' and fastening assembly 50 may be further utilized to obtain additional advantageous features without sacrificing the waterproof property of first space 15 and second space 16. These features as detailed below.

Referring to FIG. 9, there is shown a fourth embodiment of the invention. The characteristics of this embodiment are that fastening assembly 50 is implemented as rivets (not shown) on extensions 19, 19' for securing cover strip 10 to an object. Alternatively, fastening assembly 50 is implemented as elastic strips stitched to extensions 19, 19' for wrapping an object between the elastic strips and cover strip 10. Alternatively, fastening assembly 50 is implemented as zippers having one side stitched to extensions 19, 19' and the other sides. stitched to an object. Hence, cover strip 10 may be secured to the object. All of above variations are within the scope of the invention.

Referring to FIG. 10, there is shown a fifth embodiment of the invention. The characteristics of this embodiment are that fastening assembly 50 is implemented as two nylon straps 56 having a male and female fastener (such as Velcro type fasteners) 550 on one ends capable of securing to an object and the other ends stitched to extensions 19, 19'.

Referring to FIG. 11, there is shown a sixth embodiment of the invention. The difference between fifth and sixth embodiments is that the Velcro type fasteners 550 are replaced by a buckle 560. Hence, an object wrapped by reflector device may be secured by the engaged buckle 560.

Figure 12:
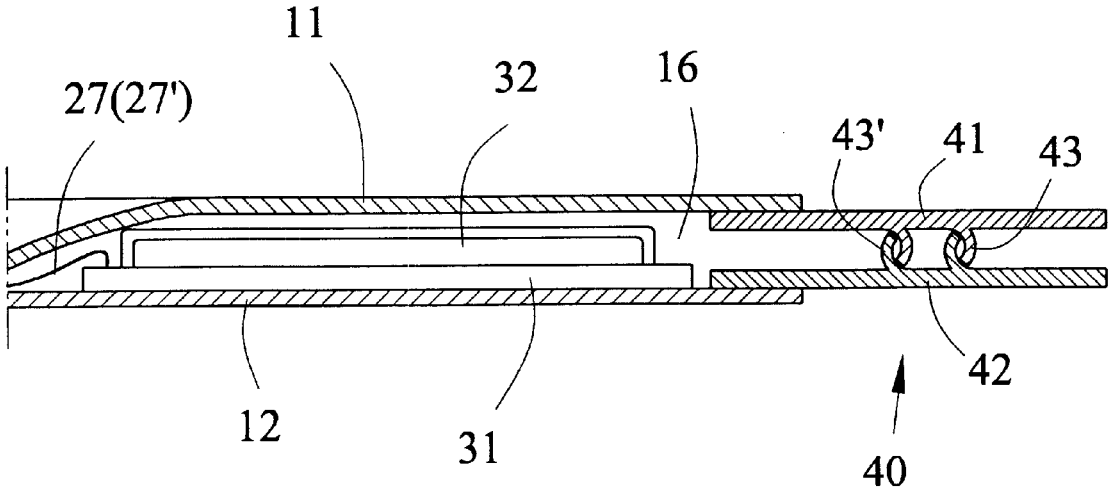
FIG. 12 is a cross-sectional view of a seventh preferred embodiment of waterproof reflector device according to the invention.

Referring to FIG. 12, there is shown a seventh embodiment of the invention. The difference between seventh and first embodiments is that the upper sealing strip 41 and lower sealing strip 42 are double configured so as to further enhance the waterproof property of reflector device. Note that cover strip 10 may be fixedly secured to an object by pressing and heating fastening assembly 50 thereon. Also, cover strip 10 or light device 20 may have a cross-section of circle, oval, triangle, U, strip, or any irregular shape. All of above variations are within the scope of the invention.

While the invention herein disclosed has been described by means of specific embodiments, numerous modifications and variations could be made thereto by those skilled in the art without departing from the scope and spirit of the invention set forth in the claims.

What is claimed is:

1. A reflector device comprising:

light means including a light emitting diode (LED) assembly having a plurality of spaced LEDs and two electric wires with the LEDs coupled therebetween, a flexible fastening strip having a plurality of spaced holes with the LEDs secured therein, and a switch coupled to the electric wires, the switch having a button;

a battery assembly including a battery compartment and a battery mounted therein, the battery assembly being electrically coupled to the switch;

waterproof means including an upper sealing strip and a lower sealing strip releasably secured to the upper sealing strip;

a cover strip including two side strips, a rear end strip, a light reflecting layer, and a base layer with the light means and the battery assembly enclosed by the light reflecting layer and the base layer by pressing the side strips and the rear end strip for sealing rear ends and sides of the light reflecting layer and the base layer wherein the waterproof means is disposed in front ends of the light reflecting layer and the base layer and the battery assembly is disposed adjacent the front ends of the light reflecting layer and the base layer being communicated with the waterproof means; and a fastening assembly having one surface secured to a bottom of base layer and the other surface secured to an object.

2. The reflector device of claim 1, wherein the light reflecting layer further comprising two spaced transverse strips for dividing the cover strip into a first space for receiving the light means and a second space for receiving the battery assembly and for securing the switch to the transverse strips with the flexible fastening strip on a top of the switch.

3. The reflector device of claim 1, wherein the cover strip further comprises two lengthwise strips pressed thereon for enhancing a securing of the light means.

4. The reflector device of claim 1, wherein the electric wires are clung to both sides of the flexible fastening strip for preventing a short circuit from occurring.

5. The reflector device of claim 1, wherein the cover strip further comprises a sticker based push button adhered on the light reflecting layer being disposed corresponding to the button of the switch.

6. The reflector device of claim 5, wherein the push button is printed on the light reflecting layer.

7. The reflector device of claim 1, wherein the upper sealing strip is secured to a bottom of the light reflecting layer and the lower sealing strip is secured to a top of the base layer respectively.

8. The reflector device of claim 1, further comprising a front end strip, wherein a portion of the light reflecting layer is open with the upper sealing strip disposed therein, the lower sealing strip is sandwiched between the light reflecting layer and the base layer, and the light reflecting layer and the base layer are sealed by pressing the front end strip, the side strips, and the rear end strip.

9. The reflector device of claim 1, wherein the waterproof means further comprises a second upper sealing strip and a second lower sealing strip releasably secured to the second upper sealing strip.

10. The reflector device of claim 1, wherein the fastening assembly is an adhesive layer.

11. The reflector device of claim 1, wherein the fastening assembly is a male type and female type fastener.

12. The reflector device of claim 1, wherein the fastening assembly comprises an elastic metal piece under the base layer and a flexible engagement layer with the metal piece sandwiched between the base layer and the engagement layer so as to secure the engagement layer, the light reflecting layer, and the base layer together by pressing the side strips and the end strips.

13. The reflector device of claim 12, further comprising a sweat absorbing pad on an underside of the engagement layer.

14. The reflector device of claim 3, further comprising two side elongate extensions on the cover strip formed by extending the lengthwise strips and the rear end strip to secure to the front end strip.

15. The reflector device of claim 14, wherein the fastening assembly is implemented as rivets on the extensions for securing the cover strip to an object.

16. The reflector device of claim 14, wherein the fastening assembly is implemented as elastic strips stitched to the extensions for wrapping an object between the elastic strips and the cover strip.

17. The reflector device of claim 14, wherein the fastening assembly is implemented as zippers having one side stitched to the extensions and the other sides stitched to an object.

18. The reflector device of claim 14, wherein the fastening assembly is implemented as two nylon straps having Velcro type fasteners on one ends capable of securing to an object and the other ends stitched to the extensions.

19. The reflector device of claim 14, wherein the fastening assembly is implemented as two nylon straps having a buckle on one ends capable of securing to an object by engaging the buckle and the other ends stitched to the extensions.

20. The reflector device of claim 1, wherein the cover strip is fixedly secured to an object by pressing and heating the fastening assembly.

21. The reflector device of claim 1, wherein the cover strip or the light means has a cross-section of strip.

22. The reflector device of claim 1, wherein the cover strip or the light means has a cross-section of circle.

23. The reflector device of claim 1, wherein the cover strip or the light means has a cross-section of oval.

24. The reflector device of claim 1, wherein the cover strip or the light means has a cross-section of triangle.

25. The reflector device of claim 1, wherein the cover strip or the light means has a cross-section of U.

26. The reflector device of claim 1, wherein the cover strip or the light means has. a cross-section of irregular shape.

* * * * *